United States Patent [19]

Hammond

[11] 4,055,329

[45] Oct. 25, 1977

[54] SCISSORS JACK

[75] Inventor: Grover M. Hammond, Streamwood, Ill.

[73] Assignee: Leisure Manufacturing Co., Inc., Des Plaines, Ill.

[21] Appl. No.: 706,787

[22] Filed: July 19, 1976

[51] Int. Cl.[2] ..... B66F 3/00

[52] U.S. Cl. ..... 254/86 R; 254/126

[58] Field of Search ..... 254/86 R, 122, 126

[56] References Cited

U.S. PATENT DOCUMENTS

| | | | |
|---|---|---|---|
| 3,741,524 | 6/1973 | Morgan et al. | 254/122 |
| 3,806,093 | 4/1974 | Itazu | 254/124 |
| 3,826,470 | 7/1974 | Spear | 254/86 R |

FOREIGN PATENT DOCUMENTS

| | | | |
|---|---|---|---|
| 498,883 | 12/1953 | Canada | 254/124 |
| 302,091 | 10/1932 | Italy | 254/126 |
| 361,316 | 11/1931 | United Kingdom | 254/126 |

*Primary Examiner*—Robert C. Watson

*Attorney, Agent, or Firm*—Silverman & Cass, Ltd.

[57] ABSTRACT

A scissors jack is adapted to be mounted permanently to the bottom frame of a vehicle and enclose the working members of the jack in the closed position. Generally, four of these scissors jacks will be mounted on the four opposite corners of the vehicle to level and stabilize the vehicle when the jacks are extended to their open position. The scissors jack has two opposed pairs of channel-shaped scissors arms. Each pair of arms is pivotally secured at a first end of the arms with the second ends having teeth formed therein. The upper arms of each pair are hingedly connected to a mounting member with their teeth intermeshed and the lower arms of each pair are hingedly connected to a baseplate with their teeth intermeshed. The second ends are mounted in the baseplate and mounting plate by rivets and each pair of rivets has a strap secured on the inside thereof to keep the teeth engaged and to relieve the stress on the rivets. A threaded rod is engaged through an internally threaded nut mounted at one pivot point of the scissors arms, a bushing is mounted at the second pivot point enabling the rod to be rotated to raise and lower the jack by opening and closing the scissors arms. The channel-shaped scissors arms are of a width and depth sufficient substantially to enclose the threaded rod when the jack is in the closed position to protect the threaded rod from debris thrown up during motion of the vehicle. The mounting member is a T-shaped member having channel-shaped arms to stabilize the jack. The T-shaped member and the baseplate have slots aligned with the teeth to allow the teeth to extend therethrough in the fully open position.

9 Claims, 7 Drawing Figures

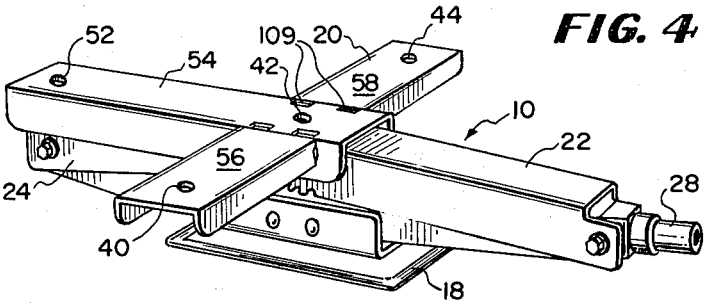
FIG. 4
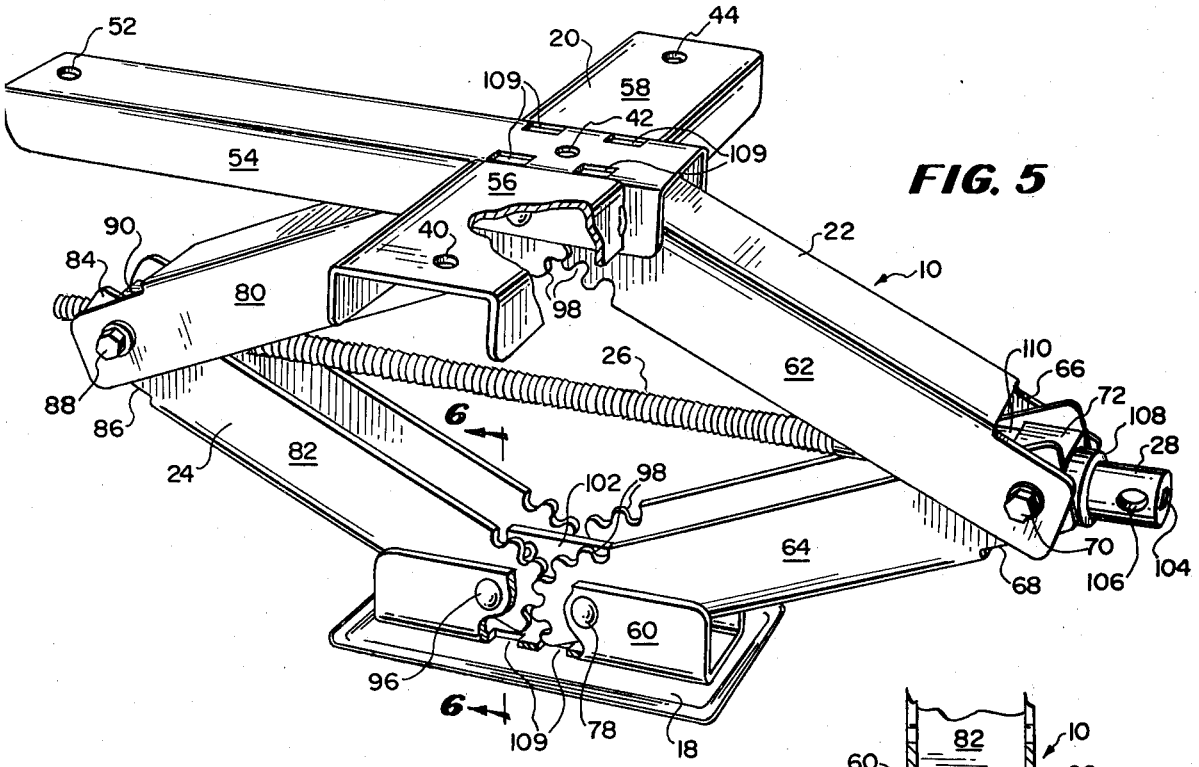
FIG. 5
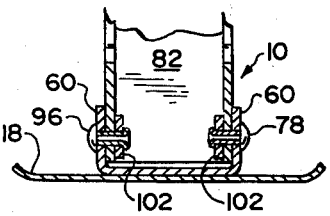
FIG. 6
FIG. 7
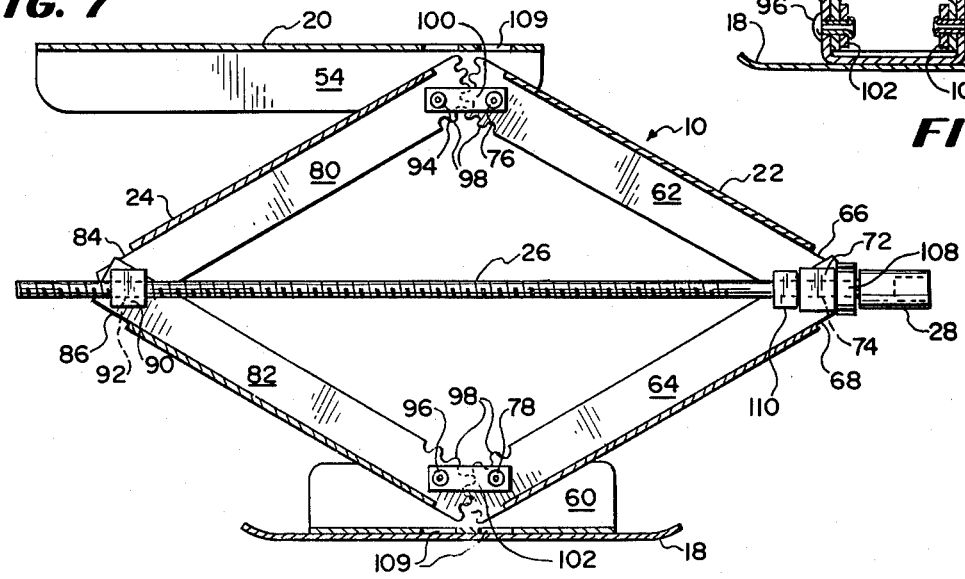

SCISSORS JACK

BACKGROUND OF THE INVENTION

The invention relates to a scissors jack for a vehicle and more particularly is concerned with a scissors jack which is adapted to be permanently mounted on the bottom frame of the vehicle to stabilize and level the vehicle.

Current interest in camping and recreational vehicles has brought about a need for more efficient stabilizing and leveling of the vehicles at a camp site. Previous jacks have been developed to solve this problem; however, they have several disadvantages including positioning the jacks at the proper point under the vehicle each time they are desired to be utilized. These need not be exhaustably discussed, but a brief mention of some will emphasize the advantages of the invention.

The scissors jack structure is generally represented by the embodiment described in U.S. Pat. No. 1,709,746 which has interchangeable outer arm elements. The arms of this jack are eight duplicate interchangeable elements with teeth on one end of the arms with the actuating rod exposed. This jack is placed in the proper position under a vehicle each time it is to be used. It has spacers between the arms to keep the teeth engaged, but does not have an internally placed strap between the pivot points at the ends of the arms.

In U.S. Pat. No. 2,479,362, a structure for engaging a threaded rod through only one pivotally mounted internally threaded nut is described. Again, this jack is intended to be positioned each time it is to be used and it also has spacers mounted on the pivot pins between the arms, but no straps on the inside of the arms. Here again, the arms are eight separate elements with the actuating rod exposed.

In U.S. Pat. No. 2,581,706 a rather complicated leveling and stabling jack is disclosed. This jack has eight L-shaped members and does have straps between the pivot points, but not on the mounting member and baseplate. This jack is adapted to substantially enclose the threaded rod and is adapted to be mounted on the underneath side of a vehicle like that of the invention, but it does so with a distinctly different structure.

U.S. Pat. No. 2,920,871 discloses a jack for an automobile very similar to previously mentioned U.S. Pat. No. 1,709,746. Again, the jack disclosed has eight separate arm elements leaving the threaded rod exposed in all positions of the jack. In this structure a separate tongue is disclosed, which is to be mounted onto the bottom of the vehicle so that the jack may be engaged with the tongue when it is to be utilized. Again, no straps are disclosed engaging the insides of the pairs of pivot points.

U.S. Pat. No. 3,317,187 discloses a scissors type jack to be put into position each time it is desired to be utilized. This jack has seven arm elements one of which is a channel-shaped member. The threaded rod substantially is exposed in all positions of the jack and no engagement straps are disclosed.

In U.S. Pat. No. 3,857,548 a scissors jack is disclosed which has a load supporting member, but it is adapted to be placed in position each time it is desired to be utilized. This jack again has eight separate arm members exposing the actuating rod and does not disclose any strap on the inside of the pivot points connecting the pairs of pivot points together.

None of these prior art structures discloses means for substantially enclosing the threaded rod to protect it from the elements and other foreign objects when it is mounted on the underneath side of the vehicle in the combination of the invention. The seven or eight separate arm elements do not have the strength and simplicity of the four channel-shaped scissors arms of the invention. The particular T-shaped mounting bracket also is not disclosed by U.S. Pat. No. 2,581,706 which does suggest mounting the jack permanently to the underneath side of a vehicle. None of the structures discloses straps between riveted pivot points to keep the teeth intermeshed or slots in the baseplate or mounting member to provide relief for the teeth of the scissors arms.

SUMMARY OF THE INVENTION

The above and other disadvantages of prior art jacks and stabilizing techniques are overcome in accordance with the present invention by providing a scissors jack which substantially totally encloses the threaded actuating rod in its closed position and is adapted to be permanently mounted to the bottom frame of a vehicle. The jack comprises a first and second pair of channel-shaped scissors arms, each pair being pivotally secured together at one end of each arm and having teeth disposed on the second end of each arm. The upper arm of each pair is hingedly connected to a mounting member with its teeth intermeshed and the lower arm of each pair is hingedly connected with its teeth intermeshed to a baseplate. The threaded actuating rod is engaged between the pivot points of the arms and is threadedly engaged through a nut at one pivot point. The mounting member and baseplate are provided with slots aligned with the teeth to provide relief for the teeth in the fully open position of the jack.

BRIEF DESCRIPTION OF THE DRAWINGS

FIG. 4 is a top perspective view of the jack;

FIG. 5 is a top perspective view of the jack partially open with portions cut away;

FIG. 6 is a sectional end view of the jack taken along line 6—6 of FIG. 5; and FIG. 7 is a sectional side view of the jack.

DESCRIPTION OF THE PREFERRED EMBODIMENT

As indicated above, the invention is concerned with a scissors jack adapted to be mounted under a vehicle to level and stabilize the vehicle when it is parked. There may be four jacks spaced around the underneath portion of the frame of the vehicle which may be opened to stabilize the vehicle or closed for movement of the vehicle. In the closed position the jack is self-contained to protect the moving parts of the jack from debris and the elements when the vehicle is in motion.

Figure 1:
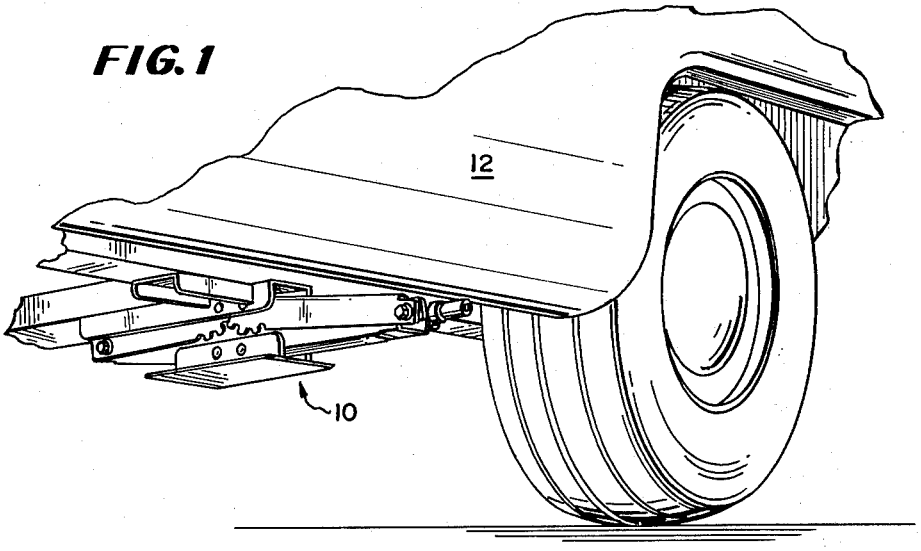
FIG. 1 is a perspective view of the scissors jack in the closed position mounted on the bottom of a vehicle frame which is partially illustrated.

Referring now to FIG. 1, the scissors jack of the invention is designated generally at 10 mounted on the bottom frame of a vehicle 12. The jack is shown in its closed position ready for the vehicle to be moved.

Figure 2:
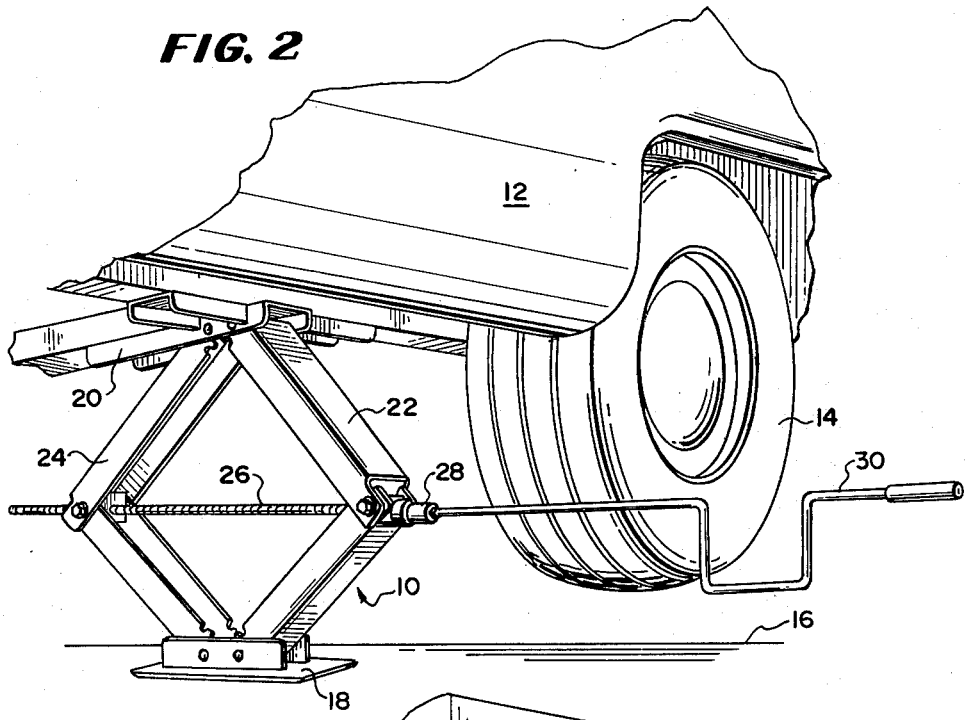
FIG. 2 is a perspective view similar to the view of FIG. 1 with the jack in the open position.

The open position of the jack 10 mounted to the vehicle 12 is best illustrated in FIG. 2. Although the jack is shown in such a position that the vehicle 12 has a wheel 14 lifted from a surface 16, the jack is intended to be used to stabilize and level the vehicle without necessarily lifting it clear of the surface 16. The jack 10, however, does have sufficient strength to lift the vehicle from the surface 16 if it is so desired.

The jack 10 has a baseplate 18 and a mounting member 20 which is adapted to mount the jack 10 to the vehicle 12. The jack has first and second pairs of scissors arms 22 and 24, each pivotally connected at a first end thereof. An externally threaded rod 26 is journaled between the pivot points of the first and second pairs of scissors arms and has an actuator or collar 28 on one end thereof. One of the pivot points is a threaded connection by which the scissors arms are opened and closed by rotation of the rod 26. The actuator 28 is adapted to be connected to any convenient means of actuation, such as a crank 30 by which the rod may be rotated to open and close the jack 10.

Figure 3:
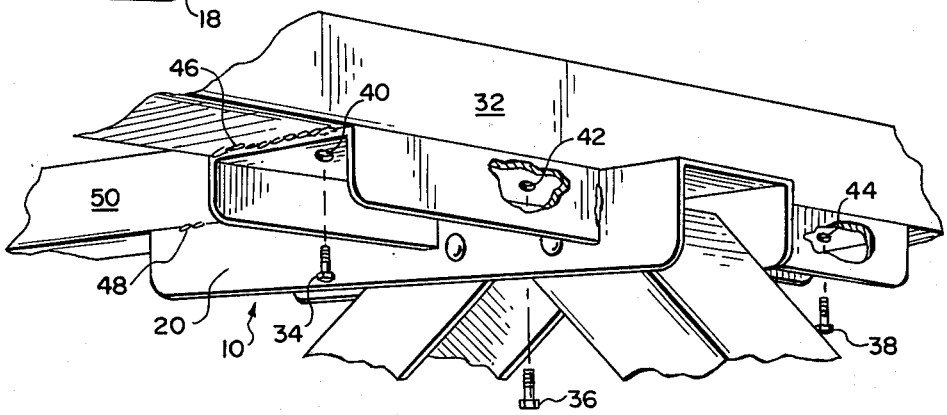
FIG. 3 is a partial exploded perspective view of the T-mounting member mounted on the underneath side of the vehicle frame.

The mounting of the jack 10 to the vehicle 12 is best illustrated in FIG. 3 which shows the jack 10 mounted to a bottom frame member 32 of the vehicle 12. As previously mentioned, there would typically be four jacks mounted at the corners of the frame 32, to distribute the weight of the vehicle 12 so that the four jacks may be opened to stabilize and to level the vehicle 12.

The mounting member 20 may be mounted to the frame 32 by any convenient method such as bolts or spot welding or both. Three bolts 34, 36 and 38 may be engaged through holes 40, 42 and 44 in the mounting member 20. There would be corresponding holes drilled in the frame 32 (not shown). The mounting member 20 may be spot-welded to the frame 32 at convenient points, only two of which are shown, 46 and 48. The number of and placement of the holes and weld points are not critical, except that the jack 10 should be securely fastened to the frame 32 to withstand the stresses and vibrations from the vehicle motion and also to withstand the stress caused by lifting the vehicle 12.

The frame member 32 is positioned parallel to the vehicle 12 and will generally have transverse cross members 50, only one of which is shown. The mounting member 20 is secured to the cross member 50 by spot welding as shown at 48 or by a bolt (not shown) secured through a fourth hole 52 (FIGS. 4 and 5) in the mounting member 20.

The jack 10 in a closed position and not mounted on the vehicle 12 is shown in FIG. 4. The mounting member 20 has a main channel-shaped member 54 which is adapted to be mounted to the cross member 50 of the vehicle frame. The mounting member has two transverse channel-shaped members 56 and 58 which are adapted to be mounted to the parallel frame member 32. The T-shape, formed by the three members 54, 56 and 58, provides the jack 10 with a strong and stable foundation for its open position.

The channel-shaped pairs of arms 22 and 24 perform a first function of enclosing the threaded rod 26 when the jack is in the closed position to protect it from debris and other foreign matter when the vehicle is in motion, and as a second function they provide strength and lateral stability of the jack against forward or backward motion of the vehicle when the jacks are in the open position.

The details of the elements of the jack 10 are most clearly illustrated in FIGS. 5 through 7. The baseplate 18 has a channel-shaped member 60 which is secured to the baseplate and opens substantially parallel to the channel-shaped member 54. The first pair of scissors arms 22 has a first arm 62 and a second arm 64 which have respective cutout portions 66 and 68 on a first end of the arms to allow the arms freely to pivot. The arms are pivotally connected at their first ends by a pair of shoulder bolts 70 only one of which is shown. Each of the shoulder bolts 70 is threadedly engaged in one side of a bushing 72 pivotally mounted between the ends of the two arms. The bushing 72 has a smooth hollow bore 74 through which the rod 26 is journaled.

The second end of the first arm 62 is hingedly connected to the channel-shaped member 54 by a pair of rivets or pins 76 engaged through the parallel side walls of the arm 62 and the channel member 54. The second arm 64 is hingedly connected by a second pair of rivets or pins 78 in the channel-shaped member 60 in a like manner as the first arm.

The second pair of scissors arms 24 has a first arm 80 and a second arm 82. The first and second arms 80 and 82 have cutout portions 84 and 86 to allow the arms freely to pivot. The first ends of the arms 80 and 82 are pivotally connected by a pair of shoulder bolts 88 only one of which is shown. The shoulder bolts 88 are threadedly engaged in each side of a nut 90 which is pivotally mounted between the first ends of the arms 80 and 82. The nut 90 has an internal threaded bore 92 through which the rod 26 is threadedly engaged. The second end of the arm 80 is pivotally mounted by a third pair of oppositely mounted rivets or pins 94 in the channel member 54. The second end of the arm 82 is pivotally mounted by a fourth pair of oppositely positioned rivets or pins 96 in the channel-shaped member 60.

The second ends of the arms 62, 64, 80 and 82 have teeth 98 arranged on their parallel side ends which are designed to restrict the movement of the scissors arms 22 and 24 to a vertical line of movement. The teeth must be kept intermeshed at all times between the opposite second ends of the arms for the jack to operate properly. To keep the teeth 98 intermeshed at all times and to relieve the stress on the pairs of rivets or pins 76, 78, 94 and 96, the opposite ones of the pairs of rivets 76 and 94, and 78 and 96 are provided with respective pairs of straps 100 and 102. As can be most clearly seen in FIG. 6, the straps 102 keep the arms in parallel alignment to keep the teeth 98 firmly intermeshed at all times.

To open or close the jack, the rod 26 is turned by means of the actuator 28. The actuator 28 has a hollow end portion 104 with a hole 106 in one or both sides which may be engaged by the crank 30 or a similar device. The actuator 28 and rod 26 are turned in a first direction to open the jack 10. The actuator 28 abuts a thrust bearing 108 which drives the thrust bearing 108 against the bushing 72 as the rod 26 is being screwed through the nut 92.

The channel members 54 and 60 are provided with slots 109 to provide relief for the ends of the teeth 98 at the extreme open position of the jack. The slots 109 make it possible for the scissors arms 22 and 24 substantially to enclose the rod 26 in the closed position with side walls of minimum thickness. Thus each scissors arm may be smaller.

To close the jack 10 the actuator 28 and rod 26 are rotated in the opposite direction which will engage a collar 110 against the inside of the bushing 72 as the rod is screwed through the nut 92. The collar 110 is pinned or otherwise affixed to the rod 26. The rod 26 is chosen to be of a length to just extend beyond the nut 92 when the jack is in the closed position and it is threaded substantially its entire length up to the collar 110 to allow the jack to be opened as far as desired.

Modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. A scissors jack comprising:

a baseplate including a first channel-shaped member secured to said plate with the channel thereof opening upwardly of said plate;

means adapted to be mounted permanently to the bottom of a vehicle including a second channel-shaped member aligned substantially parallel with said first channel-shaped member and having its channel opening downwardly towards the baseplate, said mounting means including a third and a fourth channel-shaped member having their channels opening downwardly, secured to opposite sides of said second channel-shaped member and aligned with one another substantially normal to said second channel-shaped member;

opposed pairs of channel-shaped scissors arms vertically aligned with said channel-shaped members and each pair of said arms being hingedly secured together at one end thereof to form a pivot point, the ends of each pair opposite its pivot point having teeth formed therein, the teeth of the upper arms being intermeshed and the upper arms being hingedly connected to said second channel-shaped member, and having their channels opening downwardly, the teeth of the lower arms being intermeshed and the lower arms being hingedly connected to said first channel-shaped member and having their channels opening upwardly, the toothed ends of the upper arms being disposed for pivotal movement within the channel of the second channel-shaped member and the toothed ends of the lower arms being disposed for pivotal movement within the channel of the first channel-shaped member;

a bushing mounted for limited swinging movement at one pivot point and a nut mounted for limited swinging movement at the other pivot point;

a threaded rod extending between the pivot points and journaled in the bushing for free rotation therein while threadedly engaging in the nut;

means for rotating the rod;

means for preventing axial movement of the rod relative to the bushing, the length of the rod being greater than the distance between pivot points when the scissors arms are closed to their maximum extent;

means for protecting said threaded rod when said scissors arms are closed to their maximum extent;

rotation of the rod serving to open or close the scissors arms whereby to vary the vertical spacing between the first and second channel-shaped members without changing the parallel disposition of one relative to the other;

engagement means for keeping said teeth intermeshed at all positions of said scissors arms and for relieving stress on said hinged connections of said first and second channel-shaped members;

said scissors arms hingedly connected within said first and second channel-shaped members by oppositely positioned pairs of individual pin means, each engaging one side of the hingedly connected scissors arms; and said engagement means including straps secured between opposite ones of each pair of pin means in said first and second channel-shaped members.

2. A scissors jack as claimed in claim 1 wherein said protection means include:

said channel-shaped scissors arms are of a depth substantially to enclose said threaded rod within said channels when said scissors arms are closed to the maximum extent.

3. A scissors jack as claimed in claim 1 wherein said first and second channel-shaped members include:

four relief slots aligned opposite the toothed ends of the channel-shaped scissors arms to allow said scissors arms to be opened to the maximum extent with said teeth extending into said slots.

4. In combination with a vehicle, at least one scissors jack mounted to the bottom of the vehicle frame, said scissors jack comprising:

a baseplate including a first channel-shaped member secured to said plate with the channel thereof opening upwardly of said plate;

means mounted to said bottom of said vehicle, including a second channel-shaped member mounted transversely of said vehicle and aligned substantially parallel with said first channel-shaped member and having its channel opening downwardly towards the baseplate, said mounting means including a third and a fourth channel-shaped member having their channels opening downwardly and secured to opposite sides of said second channel-shaped member, aligned with one another substantially normal to said second channel-shaped member and mounted to the bottom of said vehicle frame;

opposed pairs of channel-shaped scissors arms vertically aligned with said channel-shaped members and each pair of said arms being hingedly secured together at one end thereof to form a pivot point, the ends of each pair opposite its pivot point having teeth formed therein, the teeth of the upper arms being intermeshed and the upper arms being hingedly connected to said second channel-shaped member and having their channels opening downwardly, the teeth of the lower arms being intermeshed and the lower arms being hingedly connected to said first channel-shaped member and having their channels opening upwardly, the toothed ends of the upper arms being disposed for pivotal movement within the channel of the second channel-shaped member and the toothed ends of the lower arms being disposed for pivotal movement within the channel of the first channel-shaped member.

a bushing mounted for limited swinging movement at one pivot point and a nut mounted for limited swinging movement at the other pivot point;

a threaded rod extending between the pivot points and journaled in the bushing for free rotation therein while threadedly engaging in the nut;

means for rotating the rod;

means for preventing axial movement of the rod relative to the bushing, the length of the rod being greater than the distance between pivot points when the scissors arms are closed to their maximum extent;

means for protecting said threaded rod when said scissors arms are closed to their maximum extent;

rotation of the rod serving to open or close the scissors arms whereby to vary the vertical spacing between the first and second channel-shaped members without changing the parallel disposition of one relative to the other;

engagement means for keeping said teeth intermeshed at all positions of said scissors arms and for relieving stress on said hinged connections of said first and second channel-shaped members;

said scissors arms hingedly connected within said first and second channel-shaped members by oppositely positioned pairs of individual pin means, each engaging one side of the hingedly connected scissors arms; and said engagement means including straps secured between opposite ones of each pair of pin means in said first and second channel-shaped members.

5. A scissors jack as claimed in claim 4 wherein said protection means include:

said channel-shaped scissors arms are of a depth substantially to enclose said threaded rod within said channels when said scissors arms are closed to the maximum extent.

6. A scissors jack as claimed in claim 4 wherein said first and second channel-shaped members include:

four relief slots aligned opposite the tooth ends of the channel-shaped scissors arms to allow said scissors arms to be opened to the maximum extent with said teeth extending into said slots.

7. A scissors jack including, a baseplate including a first channel-shaped member secured to said plate with the channel thereof opening upwardly of said plate;

means adapted to be mounted permanently to the bottom of a vehicle including a second channel-shaped member aligned substantially parallel with said first channel-shaped member and having its channel opening downwardly towards the baseplate;

opposed pairs of channel-shaped scissors arms vertically aligned with said channel-shaped members and each pair of said arms being hingedly secured together at one end thereof to form a pivot point, the ends of each pair opposite its pivot point having teeth formed therein, the teeth of the upper arms being intermeshed and the upper arms being hingedly connected to said second channel-shaped member and having their channels opening downwardly, the teeth of the lower arms being intermeshed and the lower arms being hingedly connected to said first channel-shaped member;

a bushing mounted for limited swinging movement at one pivot point and a nut mounted for limited swinging movement at the other pivot point;

a threaded rod extending between the pivot points and journaled in the bushing for free rotation therein while threadedly engaging in the nut;

means for rotating the rod;

means for preventing axial movement of the rod relative to the bushing, the length of the rod being greater than the distance between pivot points when the scissors arms are closed to their maximum extent;

rotation of the rod serving to open or close the scissors arms whereby to vary the vertical spacing between the first and second channel-shaped members without changing the parallel disposition of one relative to the other;

the improvement comprising:

means for protecting said threaded rod when said scissors arms are closed to their maximum extent;

engagement means for keeping said teeth intermeshed at all positions of said scissors arms and for relieving stress on said hinged connections of said first and second channel-shaped members;

said scissors arms hingedly connected within said first and second channel-shaped members by oppositely positioned pairs of individual pin means, each engaging one side of the hingedly connected scissors arms;

said engagement means including straps secured between opposite ones of each pair of pin means in said first and second channel-shaped members; and said mounting means including a third and a fourth channel-shaped member having their channels opening downwardly, secured to opposite sides of said second channel-shaped member and aligned with one another substantially normal to said second channel-shaped member.

8. A scissors jack as claimed in claim 7 wherein said first and second channel-shaped members include:

four relief slots aligned opposite the toothed ends of the channel-shaped scissors arms to allow said scissors arms to be opened to the maximum extent with said teeth extending into said slots.

9. A scissors jack as claimed in claim 7 wherein said protection means include:

said channel-shaped scissors arms are of a depth substantially to enclose said threaded rod within said channels when said scissors arms are closed to the maximum extent.

* * * * *